US005104313A

United States Patent [19]

Zellweger

[11] Patent Number: 5,104,313

[45] Date of Patent: Apr. 14, 1992

[54] CIGARETTE LIGHTER

[75] Inventor: Conrad Zellweger, Chêne-Bourgeries, Switzerland

[73] Assignee: Parnat S.A., Geneva, Switzerland

[21] Appl. No.: 584,245

[22] Filed: Sep. 18, 1990

[30] Foreign Application Priority Data

Sep. 18, 1989 [CH] Switzerland ..... 03380/89

[51] Int. Cl.[5] ..... F23D 11/36

[52] U.S. Cl. ..... 431/277; 431/153

[58] Field of Search ..... 431/133, 135, 136, 137, 431/138, 139, 140, 141, 144, 267, 273, 274, 275, 276, 277, 153

[56] References Cited

U.S. PATENT DOCUMENTS

| | | | |
|---|---|---|---|
| 2,513,125 | 6/1950 | Wiessner | 431/137 |
| 3,642,421 | 2/1972 | Okabe | 431/254 |
| 3,898,031 | 8/1975 | Rosakowicz | 431/153 X |
| 4,784,602 | 11/1988 | Nitta | 431/277 X |
| 4,822,276 | 4/1989 | Bisbee | 431/153 |

FOREIGN PATENT DOCUMENTS

| | | | |
|---|---|---|---|
| 0285748 | 10/1988 | European Pat. Off. . | |
| 0296281 | 12/1988 | European Pat. Off. . | |
| 1009419 | 5/1952 | France . | |
| 845002 | 8/1960 | United Kingdom | 431/277 |

*Primary Examiner*—Carl D. Price

*Attorney, Agent, or Firm*—Young & Thompson

[57] ABSTRACT

A combustible fluid lighter includes a body with a reservoir for combustible fluid and a striking mechanism. A movable control member has at least two degrees of freedom and is manually actuated. The assembly of the control member and striking mechanism is a kinematic train which includes a coupling having two parts that are uncoupled in a rest position. At least one of these parts is displaceable for engagement by a movement of the control member other than that necessary for actuating the striking device. A resilient member is provided to return the coupling to its uncoupled position. The actuating member is a rotatable wheel adapted to drive in rotation a portion of the striking mechanism. The coupling can be a clutch device, in which case a relative axial displacement between the rotatable wheel and a portion of the striking device is necessary for engaging the two parts of the coupling. Or the rotatable wheel can be turnably and slidably mounted relative to the body of the lighter, this wheel being subjected to the action of a resilient member tending to displace it axially to uncouple the clutch device.

4 Claims, 1 Drawing Sheet

CIGARETTE LIGHTER

It is known that children greatly enjoy playing with cigarette lighters unwisely left within their reach by their parents, but that this can sometimes lead to burns or even fires.

Various solutions have been proposed to render difficult striking a lighter by a child (for example in U.S. Pat. Nos. 4,717,335 and 4,786,248). According to these patents, the manually operated member for controlling striking is blocked, which can inspire the child to find a way to unblock it.

The present invention has for its object to render striking a cigarette lighter difficult for a child, without at the same time blocking the manually operated member for controlling striking. Thus, the infant can play with the movable member, which is enough to satisfy him.

To this end, the invention has for its object a lighter with combustible fluid comprising a body with a combustible fluid reservoir and a striking mechanism, a movable control member having at least two degrees of freedom adapted to be manually actuated, the assembly of the control member and the striking mechanism constituting a kinetic train, characterized in that this train comprises a coupling whose two parts are uncoupled in the rest position, at least one of said parts being displaced for engagement by a movement of the control member other than that necessary to actuate the striking device.

The accompanying drawing shows schematically and by way of example two embodiments of lighter according to the invention.

Figure 1:
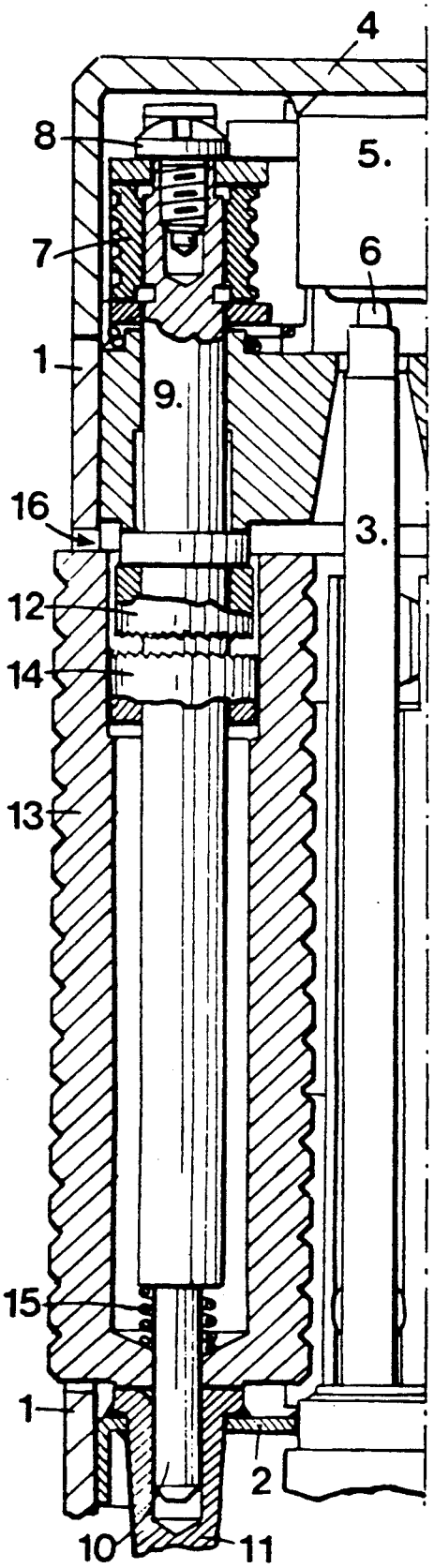
Figure 2:
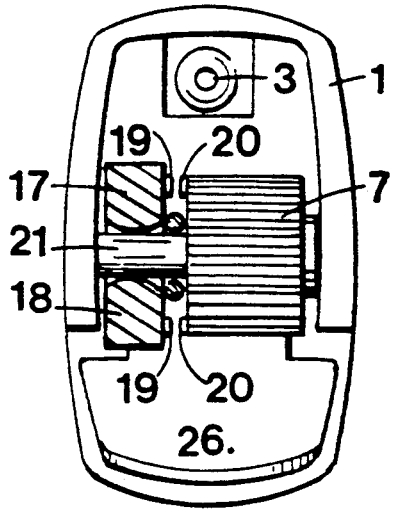
Figure 3:
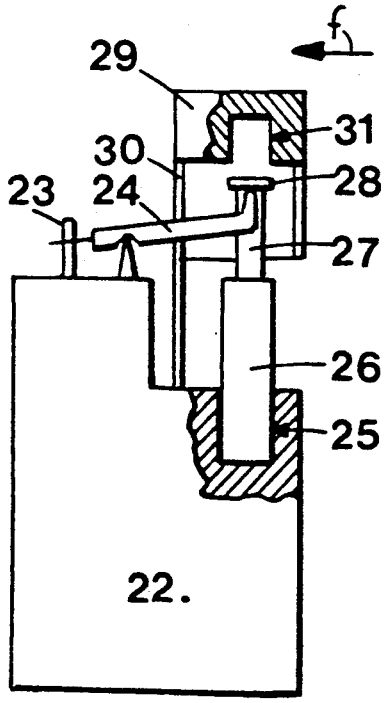

FIG. 1 is a cross section of a portion of the lighter according to the first embodiment; and FIG. 2 is a plan view partially in section of the second embodiment.

With reference to FIG. 1, the lighter, for example of the type of that shown in Swiss patent No. 325,936, comprises a body 1, a reservoir 2, a burner 3, a cover 4 provided with a member 5 adapted to cooperate with a control rod 6 for closing a valve which is part of the burner 3. The striking device comprises a striking wheel 7 coacting with a non-illustrated pyrophoric flint. This wheel 7 is fixed by a screw 8 on a pivot 9, whose lower end 10 is engaged in a bearing 11. This pivot is fixed to a coupling part 12 and passes through a manually actuated wheel 13 which carries the other part 14 of the coupling.

The wheel 13 is pressed in the direction of the bearing 11 by an elastic member constituted by a spring 15 and can be displaced against the action of this latter thanks to a clearance 16 provided between the upper end of the wheel and the body 1. This axial displacement engages the two parts 12 and 14 of the coupling, such that after this axial displacement the wheel 13 can be driven in rotation to actuate the striking wheel 7. It follows that it is not necessary to separate the axial displacement and the rotatable displacement and that if the user exerts an oblique action directed upwardly on the wheel 13, this latter can be driven in rotation and at the same time displaced to effect its coupling with the striking wheel 7. If a young child plays with the lighter, he will have the tendency to turn the wheel 13 without pushing it axially against the action of spring 15, such that the parts 12 and 14 are not mutually engaged and therefore the striking wheel 7 cannot be driven in rotation.

FIG. 2 shows a construction provided for a lighter of the throw-away type. In this view, which shows the lighter from above, will be seen the body 1 which constitutes at the same time the reservoir of the lighter, the burner 3 and its lever 26 controlling the opening of the valve of this burner. Contrary to known constructions, the striking wheel 7 and the actuating wheel 17 are not secured to each other, but slightly spaced and held spaced by a toric joint 18 of elastomeric material. Teeth 19 and 20 are provided on the two facing surfaces of the wheels 7 and 17, but are not in engagement because of the elastic pressure exerted by the toric joint 18.

The wheel 7 is secured to an axle 21, on which the wheel 17 turns freely. It will be seen that the central hole of the wheel 17 is chamfered at its two ends, such that it can be inclined relative to a plane perpendicular to the axle 21. As a result, to be able to strike the lighter, it is necessary to exert on the wheel 17, in addition to the usual rotation movement, an oblique action which permits at least two teeth 19 and 20 to engage to permit driving the wheel 7.

Of course numerous other embodiments could be foreseen, the important point being to prevent actuation of the striking mechanism by the actuating member when a single displacement in a single direction is imparted to said member.

What is claimed is:

1. In a combustible fluid lighter comprising a body with a reservoir for combustible fluid, a flint, a flint wheel, an actuating wheel for turning said flint wheel, and a common pivot carrying the two said wheels, said two wheels being coaxial; the improvement comprising coupling means having two parts respectively connected to each said wheel, said actuating wheel being movably mounted on said pivot between a coupled position in which said two parts of the coupling means are engaged and a rest position in which said two parts of said coupling means are disengaged, elastic means yieldably urging said actuating wheel toward said rest position, movement of said actuating wheel against the action of said elastic means from said rest position to said coupled position permitting said flint wheel to be driven by manual action on said actuating wheel.

2. A lighter as claimed in claim 1, in which said actuating wheel is axially slidable on said pivot.

3. A lighter as claimed in claim 1, in which said actuating wheel is oscillatably mounted on said pivot for tilting movement relative to said axis.

4. A lighter as claimed in claim 1, in which said coupling is a toothed clutch.

* * * * *